US007451899B2

(12) United States Patent
de Pous

(10) Patent No.: US 7,451,899 B2
(45) Date of Patent: Nov. 18, 2008

(54) FASTENER ASSEMBLY FOR FASTENING A FLUID DISPENSER MEMBER

(75) Inventor: Olivier de Pous, Paris (FR)

(73) Assignee: Valois S.A.S, Le Neubourg (FR)

( * ) Notice: Subject to any disclaimer, the term of this patent is extended or adjusted under 35 U.S.C. 154(b) by 176 days.

(21) Appl. No.: 11/446,259

(22) Filed: Jun. 5, 2006

(65) Prior Publication Data

US 2006/0273115 A1 Dec. 7, 2006

Related U.S. Application Data

(60) Provisional application No. 60/729,751, filed on Oct. 25, 2005.

(30) Foreign Application Priority Data

Jun. 3, 2005 (FR) ..... 05 51497

(51) Int. Cl.
*B65D 88/54* (2006.01)

(52) U.S. Cl. ..... 222/321.9; 215/274

(58) Field of Classification Search ... 222/321.7–321.9, 222/385, 383.1, 402.1; 215/324–328, 12.1, 215/364, 347, 274–279, 280
See application file for complete search history.

(56) References Cited

U.S. PATENT DOCUMENTS 4,607,757 A * 8/1986 Lecinski ..... 215/246
5,562,219 A * 10/1996 de Pous et al. ..... 215/274
6,273,303 B1 * 8/2001 de Pous et al. ..... 222/402.1
6,315,169 B1 * 11/2001 de Rosa ..... 222/321.7
6,575,339 B2 * 6/2003 Jourdin et al. ..... 222/321.7
6,672,488 B2 * 1/2004 de Pous ..... 222/321.9
2001/0054624 A1 * 12/2001 Jourdin et al. ..... 222/321.7
2004/0074926 A1 4/2004 Petit

FOREIGN PATENT DOCUMENTS

DE 2200845 A1 7/1973
FR 2508136 A 12/1982
WO WO 88/02297 A 4/1988

* cited by examiner

*Primary Examiner*—Lien T Ngo
(74) *Attorney, Agent, or Firm*—Sughrue Mion, PLLC

(57) ABSTRACT

A fastener assembly (1, 2) for fastening a fluid dispenser member (3), such as a pump or a valve, designed to be associated with a neck (51) of a receptacle (5), said assembly comprising: a fastener ring (1) provided with securing means (10) for securing the ring to the receptacle neck, and fastener means (11) for fastening the dispenser member (3); and a trim band (2) mounted around the ring (1) in a manner such as to mask said ring at least in part; said fastener assembly being characterized in that said band is made of at least two distinct materials, said two materials comprising a metal material (20) and a plastics material (21).

19 Claims, 4 Drawing Sheets

FASTENER ASSEMBLY FOR FASTENING A FLUID DISPENSER MEMBER

CROSS REFERENCE TO RELATED APPLICATION

This application claims the benefit under 35 U.S.C. §119 (e) of pending U.S. provisional patent application Ser. No. 60/729,751, filed Oct. 25, 2005, and priority under 35 U.S.C. §119(a)-(d) of French patent application No. FR-05.51497, filed Jun. 3, 2005.

TECHNICAL FIELD

The present invention relates to a fastener assembly for fastening a fluid dispenser member, such as a pump or a valve, designed to be associated with or fastened to a neck of a receptacle, said assembly comprising: a fastener ring provided with securing means for securing the ring to the receptacle neck, and fastener means for fastening the dispenser member; and a trim band mounted around the ring in a manner such as to mask said ring at least in part.

Cosmetics, perfumes, and pharmaceuticals are the preferred but not exclusive fields of application of the present invention.

BACKGROUND OF THE INVENTION

Numerous fluid dispenser systems are known from the prior art. Such a system generally comprises a receptacle containing a fluid to be dispensed by means of a dispenser member such as a pump or a valve. The receptacle is provided with a neck that defines an opening through which said dispenser member extends. Said dispenser member is secured to the neck by means of a fastener ring. Said fastener ring can be screwed, snap-fastened, or crimped to the neck of the receptacle. In addition, a trim band, covering said ring at least in part, can be used. Said band generally aims to hold the ring more securely to the neck and/or to provide an appearance-enhancing function. Such a band is usually made of a plastics material or of a metal material.

Making the band of plastic offers the advantage of giving a wide choice of materials and opens up numerous possibilities for diversifying the trim (shape, color, texture, etc.). Due to their distinct structural and visual characteristics, these materials can thus contribute to decorating the dispenser system and provide an additional enhancement in appearance. However, such materials generally lack resistance to impacts and tend to break.

Making the band of metal imparts robustness to the band. However, the appearance-enhancing effect is limited since metal materials generally have visual characteristics that are not very distinctive depending on the material chosen. In addition, the shapes are also limited because they are constrained by metal machining techniques.

BRIEF SUMMARY OF THE INVENTION

An object of the present invention is to provide a trim band that overcomes the above-mentioned drawbacks of the prior art.

Another object of the present invention is to provide a band that combines robustness with appearance enhancement.

More particularly, an object of the present invention is to provide a band whose component materials offer a large range of appearance-enhancing effects (colors, textures) while imparting high resistance to impacts.

Another object of the present invention is to provide a band that is simple and inexpensive to manufacture and to assemble.

The present invention thus provides a fastener assembly for fastening a fluid dispenser member, such as a pump or a valve, designed to be associated with a neck of a receptacle, said assembly comprising: a fastener ring provided with securing means for securing the ring to the receptacle neck, and fastener means for fastening the dispenser member; and a trim band mounted around the ring in a manner such as to mask said ring at least in part; said fastener assembly being characterized in that said band is made of at least two distinct materials, said two materials comprising a metal material and a plastics material. The association of at least one plastics material and of at least one metal material thus firstly imparts to the band good capacity for resisting impacts, and secondly makes it easy to adapt the appearance of the band to accommodate customer desires and market trends.

Advantageously, the band includes a metal insert suitable for being held securely in contact with the plastics material.

Advantageously, the plastics material forms a drum covering said metal insert at least in part.

Advantageously, the metal insert is embedded entirely in the drum.

Advantageously, the metal insert forms a sleeve that is concentric with said plastics drum.

Advantageously, the metal sleeve defines a wall that is preferably substantially cylindrical, said wall being provided with at least one through opening, the opening having an outside edge and an inside edge, the plastics material of which the drum is made penetrating into said openings while covering at least one edge of each of said openings, thereby guaranteeing that the sleeve is anchored securely in said drum.

Advantageously, said plastics material is overmolded on said metal insert.

Advantageously, the plastics material extends through said opening and projects radially inwards beyond the inside edge of the opening.

Advantageously, the plastics material remains radially set back inside the opening so that the inside edge of the opening remains uncovered or "sharp".

Advantageously, the band is provided with a holding profile suitable for coming into engagement with a setback formed by the ring. Thus, any possibility of the band being withdrawn relative to the ring is prevented.

In an advantageous first variant, the holding profile is formed by the drum made of a plastics material.

In an advantageous second variant, the holding profile is formed by the metal insert.

In another embodiment of the invention, the metal material forms a metal sleeve defining an inside wall, the plastics material being overmolded on the inside wall, the plastics material advantageously forming a projecting profile, such as a thread.

BRIEF DESCRIPTION OF THE DRAWINGS

Other characteristics and advantages of the present invention will appear more clearly on reading the following detailed description of embodiments thereof, given with reference to the accompanying drawings which are given by way of non-limiting example, and in which.

DETAILED DESCRIPTION

Figure 1:
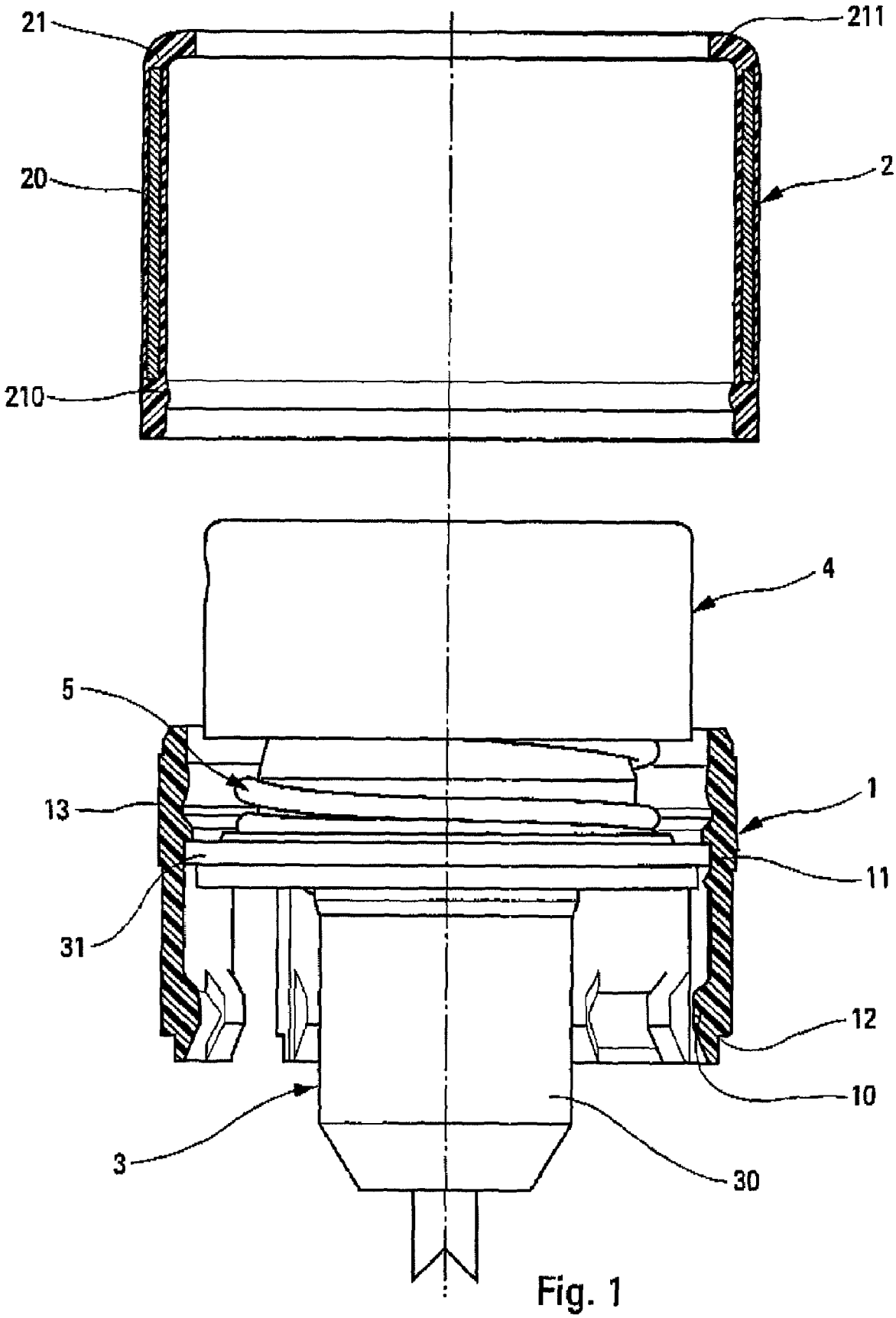
FIG. 1 is a diagrammatic view partially in section of a fastener assembly of the invention, in the non-assembled state.

The fastener assembly of the invention is made up of two component parts, namely a fastener ring 1 and a trim band 2.

The fastener ring 1 has an inside wall forming securing means 10 for securing the ring 1 to a fluid receptacle 5 (shown in part), and fastener means 11 for fastening to a dispenser member 3.

The receptacle 5 has a body (not shown) forming a shoulder 54 from which a neck 51 extends. The neck defines an opening 50 that puts the inside of the body into communication with the outside. The neck also forms an annular top edge 53 and an annular outside rim 52 defined by a peripheral setback. The rim 52 serves as engagement means co-operating with the securing means 10.

In this example, the securing means 10 are formed by snap-fastening heads. Said heads are suitable for deforming outwards so as to pass over and then engage under the rim 52 of the neck. However, other means for securing the ring to a fluid receptacle neck can be used, such as screw-threads, or crimping. It can also be observed that the ring forms a peripheral annular setback 12 in its outside wall, substantially at the heads 10. Said setback 12 can also be provided higher on the ring. Said setback 12 serves as latch means co-operating with the band, as explained below. The ring also has a peripheral belt 13 that forms a slight thickening of the wall.

The function of the fastener means 11 is to hold the dispenser member 3 securely in the opening 50 in the neck 51. The dispenser member can be a pump or a valve. In the example shown in FIGS. 1 and 3, said member is a pump 30 having a body 30 defining a fluid dispensing chamber. Said body has a top end provided with a collar 31 projecting radially outwards, and a bottom end suitable for being connected to a dip tube (not shown). Usually a piston secured to an actuating rod is mounted to slide in leaktight manner in the body 30. Said piston can then be moved back and forth inside the body of the pump by manually actuating a pusher 4. Thus, the piston is pushed into the body 30 by pushing on the pusher 4, and is then returned to an initial rest position under drive from a return spring 5 which, in this example, is provided between said body and said pusher. The structure and the operation of such a pump are known per se and are not described in any more detail below. In addition, it should be specified that the dispenser member implemented is not limiting for the present invention.

Figure 2:
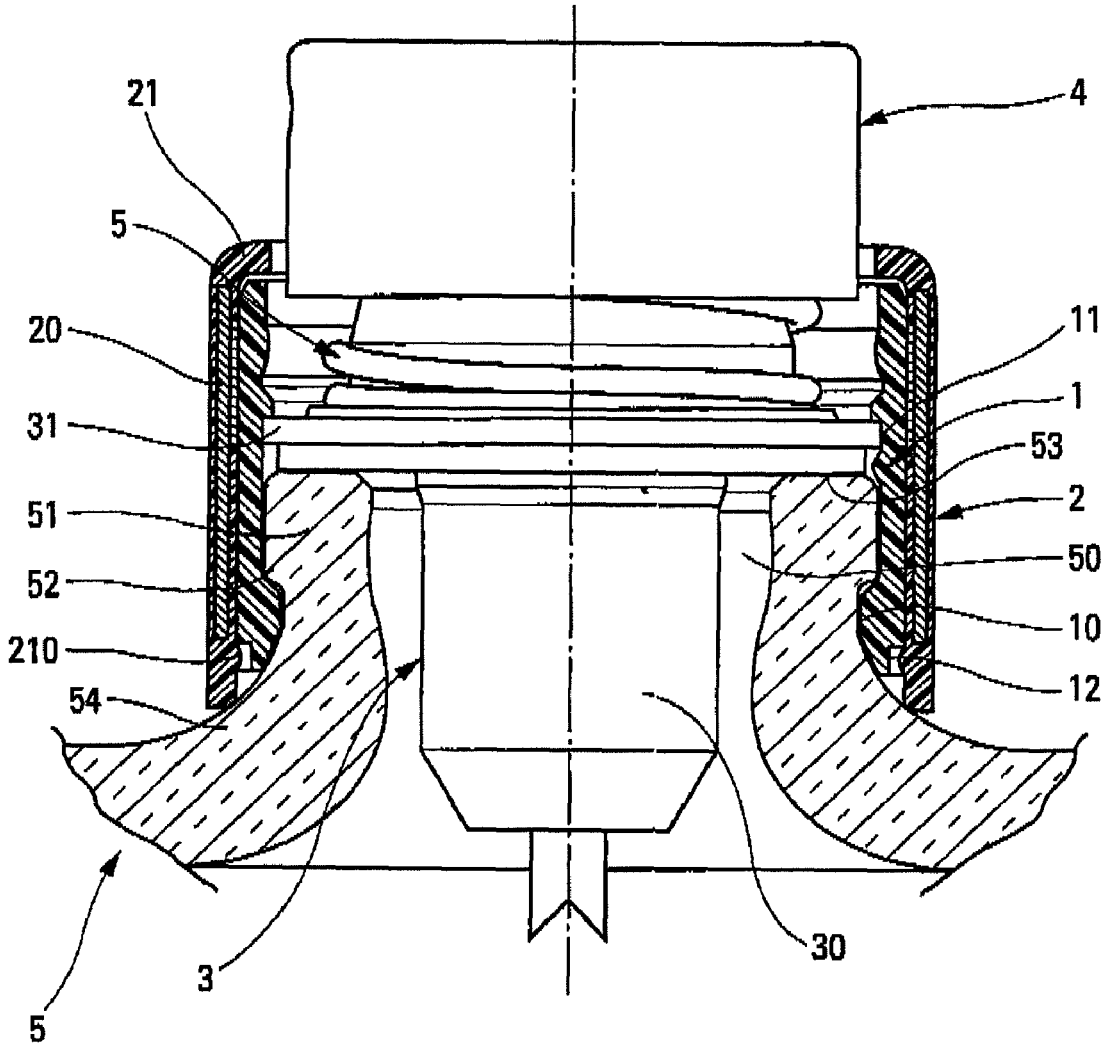
FIG. 2 is a diagrammatic view of the fastener assembly of FIG. 1 in the assembled state.

In the embodiment shown in FIGS. 1 and 2, the fastener means are in the form of a recess 11 in which the dispenser member 3 is received with the collar 31 being snap-fastened. However, any other suitable means for fastening the dispenser member could be implemented.

The trim band 2 is designed to cover the fastener ring 1 at least in part. The band thus masks the ring 1 at least in part. Such covering makes it possible both to improve the securing of the ring to the neck and also to enhance appearance. The band comes into contact with the ring at the securing means which are thus permanently locked under the rim 52 of the neck. The band preferably extends down to below the bottom end of the ring into contact with the shoulder 54. At its top end, the band forms an inwardly-extending flange 211 that can come into abutment against the ring. The band advantageously comes into pressed contact with the belt 13 in order to improve the stability of the band on the ring.

The trim band of the invention offers the feature of being made of at least one metal material and of at least one plastics material. Thus, said band has two distinct portions, namely a metal portion 20 and a plastics portion 21.

Figure 3:
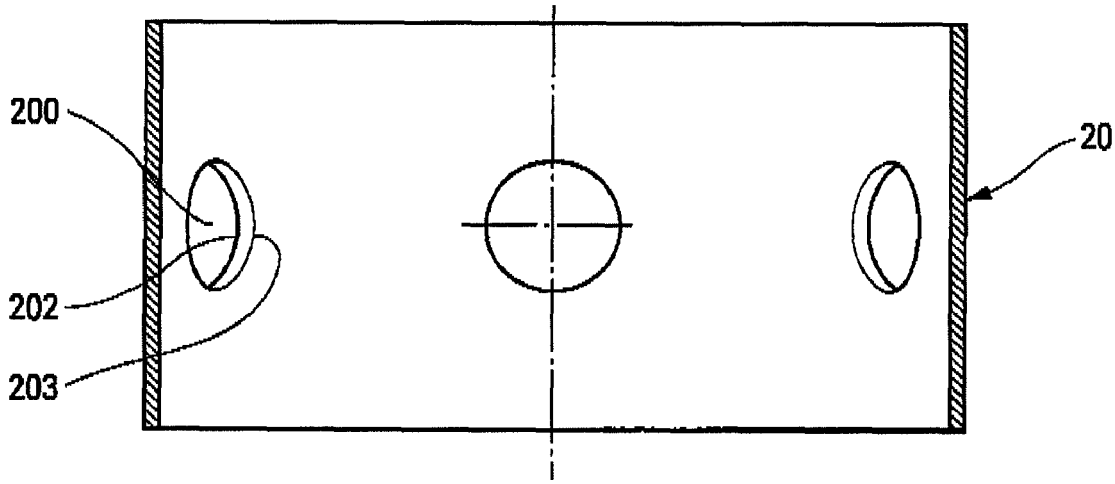
FIG. 3 is a diagrammatic view of an embodiment of a portion of a trim band of the invention.

The metal portion 20 is advantageously in the form of an insert held securely in contact with the plastics portion 21 by any suitable means. Advantageously, said insert is cylindrical in configuration, thereby forming a sleeve. As shown in FIG. 3, said insert defines a wall through which at least one opening 200 can be provided. Said opening(s) can then be of any suitable shape, such as circular, oval, rectangular, square, etc. Each opening 200 defines an outside edge 202 and an inside edge 203. The function of these openings is explained in more detail below. It should be noted that said insert 20 can be formed by a single piece or by a plurality of distinct pieces. The insert can also have no openings, as shown in FIGS. 1 and 2.

Figure 4A:
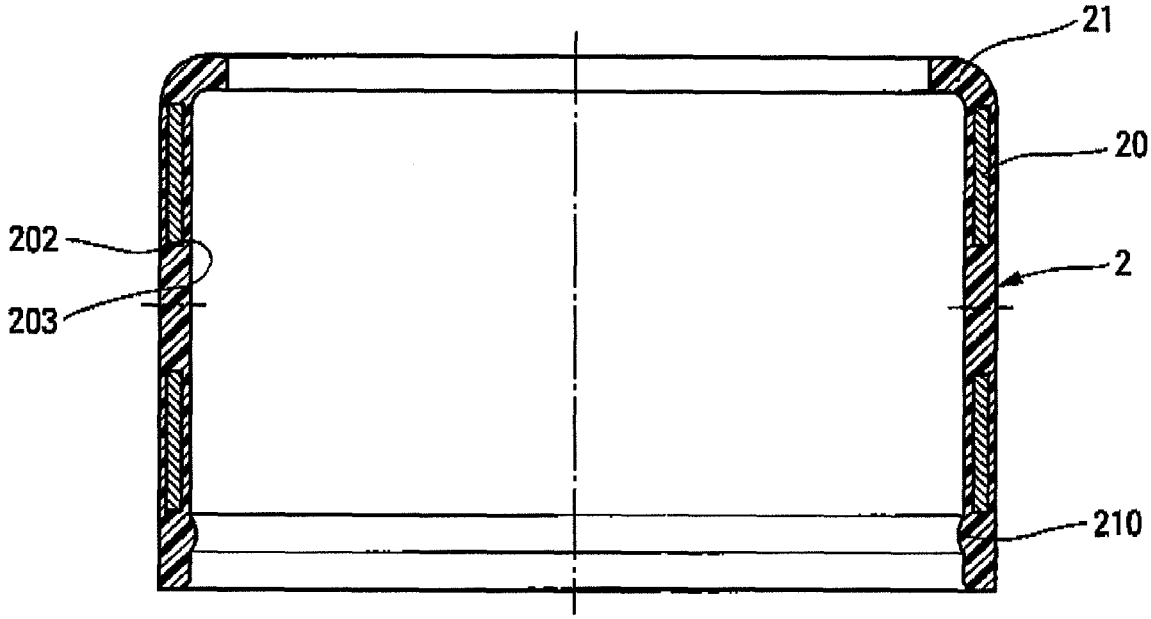
FIGS. 4*a* to 4*d* show variant embodiments of a trim band of the invention.
Figure 4B:
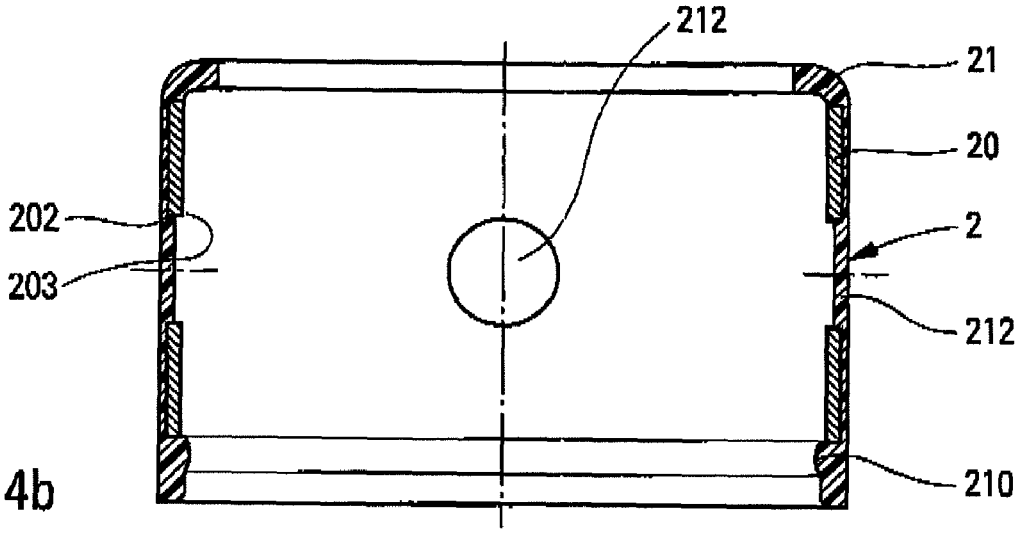
Figure 4C:
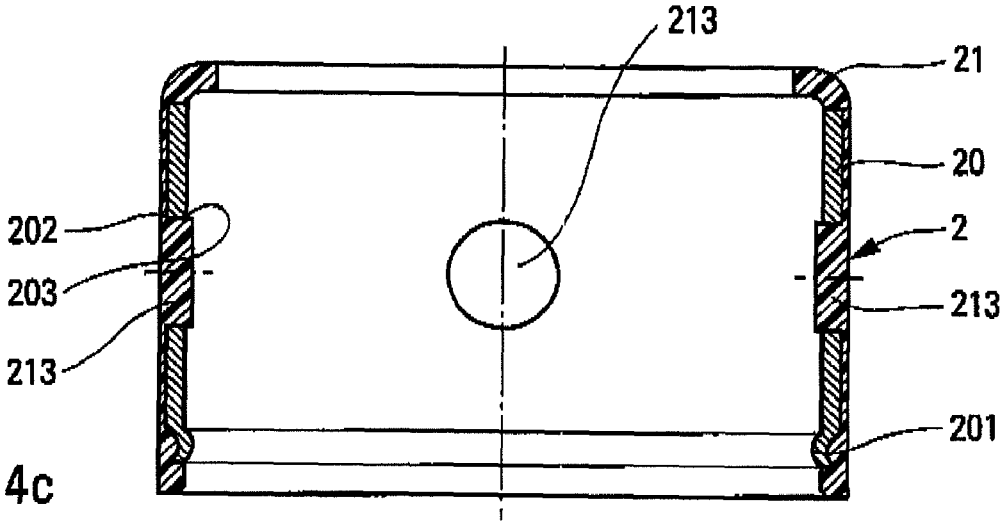

The plastics portion 21 advantageously forms a drum covering the metal insert 20 in part (FIG. 4*b* and FIG. 4*c*) or in full (FIG. 4*a*). For this purpose, the plastics piece is preferably overmolded on said metal insert. The plastics drum can then be organized to extend concentrically around the metal insert. The plastics drum preferably covers the outside face of the metal insert, so that the insert is not visible once the band is mounted on the ring. In order to guarantee strong cohesion between the plastics portion and the metal portion, the plastics material can penetrate into the openings 200 provided through the metal insert 20. As a result, the metal insert is then anchored more securely in the plastics drum. As shown in FIGS. 4*a*, 4*b*, and 4*c*, the plastics material can then be arranged in different manners relative to the metal insert.

In FIG. 4*a*, the metal insert 20 is entirely embedded in the plastics material 21, so that the insert 20 is made totally invisible. The plastics material then extends on either side of the metal insert, and through the openings 200.

In FIG. 4*b*, the plastics material extends over only one face of the metal insert (the outside face in this example). In this Figure, the plastics material extends into the openings 200 in the insert 212 but remains set back relative to a plane defined by the inside face of said insert. Thus, the plastics material leaves the inside edge 203 of the opening uncovered or "sharp".

As in FIG. 4*b*, in FIG. 4*c* only the outside face of the insert is covered with the plastics material, the inside face remaining uncovered. However, unlike in the embodiment shown in FIG. 4*b*, the plastics material extends through the openings 200 of the insert and projects radially inwards beyond the plane defined by the inside face of said insert. The plastics material thus forms a stud 213 that masks the inside edge 203. Once the band is mounted on the ring, said projecting stud 203 comes into pressed contact with the outside of the ring, which then creeps around the stud. The same applies when the plastics material remains set back in the opening: the ring creeps into the opening and comes into engagement with the inside edge 203. Thus, in both of the embodiments shown in FIGS. 4*b* and 4*c*, the band is held more securely on the ring by the fact that the inside wall of the band is not smooth or cylindrical: the ring can be fastened by creeping over or into the projecting or recessed profiles.

In addition, the band can also be provided with a holding profile 210, 201 suitable for preventing any possibility of the band being withdrawn relative to the ring after the band has been assembled to the ring. Said holding profile comprises an internal annular swelling suitable for being received in an annular setback 12 provided in the thickness of the ring 1. As shown in FIGS. 1, 2, 4*a*, and 4*b*, the holding profile 210 can be formed by the drum made of the plastics material 21. In a variant, as shown in FIG. 4*c*, the holding profile 201 can be formed by the metal insert 20. The holding profile 201, 210 forms a wall reinforcement which is positioned at the securing means for securing the ring, thereby further improving the locking under the rim 52 of the neck.

Figure 4D:
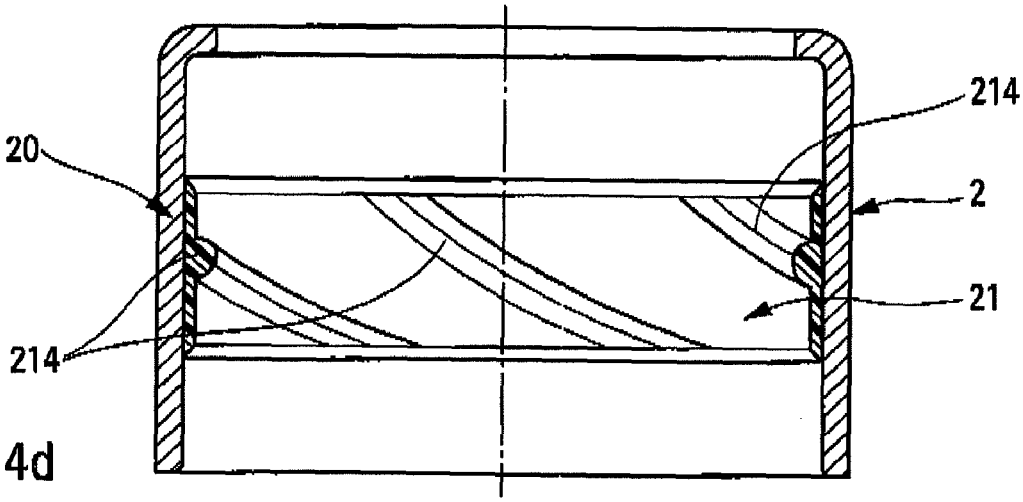

FIG. 4*d* shows yet another embodiment of the invention, in which the band 2 has a metal body in the form of a substantially cylindrical sleeve 20. Said sleeve 20 is provided with an inwardly-extending flange at its top edge. The sleeve 20 has the same shape as the shape of a conventional metal band. However, the inside wall of the sleeve 20 is provided with a plastics material 21 which is advantageously overmolded on the inside wall of the sleeve. The plastics material can be in the form of an inner ring which advantageously forms one or more projecting profile(s) 214, such as a thread, as shown in FIG. 4*d*. This internal thread 214 is designed to come into engagement with the outside wall of the fastener ring 1. The plastics material is advantageously harder than the material of the ring, so that the thread 214 can bit into the ring.

The present invention thus makes it possible to provide a trim band that reconciles the advantages inherent to plastics materials, namely ease of molding and of shaping, with the advantages inherent to metal materials, namely strength. Such an invention thus ensures that bands can be manufactured that are customizable in appearance and that offer high strength.

Although the present invention is described above with reference to embodiments thereof, the invention is not limited to these embodiments. Other useful modifications could be made by the person skilled in the art without going beyond the ambit of the present invention as defined by the accompanying claims.

The invention claimed is:

1. A fastener assembly (1, 2) for fastening a fluid dispenser member (3) designed to be associated with a neck (51) of a receptacle (5), said assembly comprising:

a fastener ring (1) provided with securing means (10) for securing the ring to the receptacle neck, and fastener means (11) for fastening the dispenser member (3); and a trim band (2) mounted around the ring (1) in a manner such as to mask said ring at least in part;

said fastener assembly being characterized in that said band is made of at least two distinct materials, said two materials comprising a metal material (20) and a plastics material (21).

2. A fastener assembly according to claim 1, in which the band (2) includes a metal insert (20) suitable for being held securely in contact with the plastics material (21).

3. A fastener assembly according to claim 2, in which the plastics material (21) forms a drum covering said metal insert (20) at least in part.

4. A fastener assembly according to claim 3, in which the metal insert (20) is embedded entirely in the plastics drum (21).

5. A fastener assembly according to claim 3, in which the metal insert (20) forms a sleeve that is concentric with said plastics drum (21).

6. A fastener assembly according to claim 2, in which said plastics material (21) is overmolded on said metal insert (20).

7. A fastener assembly according to claim 5, in which the metal sleeve (20) defines a wall that is preferably substantially cylindrical, said wall being provided with at least one through opening (200), the opening having an outside edge (202) and an inside edge (203), the plastics material of which the drum (21) is made penetrating into said openings while covering at least one edge of each of said openings, thereby guaranteeing that the sleeve (20) is anchored securely in said drum (21).

8. A fastener assembly according to claim 7, in which the plastics material (21) extends through said opening (200) and projects radially inwards beyond the inside edge (203) of the opening.

9. A fastener assembly according to claim 7, in which the plastics material (21) remains radially set back inside the opening (200) 50 that the inside edge (203) of the opening remains uncovered.

10. A fastener assembly according to claim 1, in which the band (2) is provided with a holding profile (201; 210) suitable for coming into engagement with a setback (12) formed by the ring.

11. A fastener assembly according to claim 10, in which the holding profile (210) is formed by the drum (21) made of a plastics material.

12. A fastener assembly according to claim 10, in which the holding profile (201) is formed by the metal insert (20).

13. A fastener assembly according to claim 2, in which the insert has an outside surface that is entirely covered with plastics material.

14. A fastener assembly according to claim 1, in which the metal material (20) forms a metal sleeve defining an inside wall, the plastics material (21) being overmolded on the inside wall, the plastics material advantageously forming a projecting profile (214), such as a thread.

15. The fastener assembly according to claim 1, wherein the fluid dispenser is a pump or a valve.

16. The fastener assembly according to claim 14, wherein the projecting profile is a thread.

17. A fastener assembly for fastening a fluid dispenser member to a neck of a receptacle, the assembly comprising:

a ring configured to grasp and be secured to the receptacle neck and configured to secure the dispenser member; and a trim band mounted around the ring so as to mask the ring at least in part; and wherein the band comprises metal and plastic materials; and wherein the metal and plastic materials are mounted around the ring.

18. The fastener assembly according to claim 17, wherein the metal and plastic materials when mounted are disposed radially outside the ring.

19. The fastener assembly according to claim 17, wherein the plastic material is overmolded on the metal material.

* * * * *